US006409226B1

(12) United States Patent
Slack et al.

(10) Patent No.: US 6,409,226 B1
(45) Date of Patent: Jun. 25, 2002

(54) "CORRUGATED THICK-WALLED PIPE FOR USE IN WELLBORES"

(75) Inventors: Maurice William Slack; Trent Michael Victor Kaiser; Gerald Adrien Joseph Beaulac, all of Edmonton (CA)

(73) Assignee: Noetic Engineering Inc., Edmonton (CA)

( * ) Notice: Subject to any disclaimer, the term of this patent is extended or adjusted under 35 U.S.C. 154(b) by 0 days.

(21) Appl. No.: 09/566,345

(22) Filed: May 4, 2000

Related U.S. Application Data

(60) Provisional application No. 60/132,632, filed on May 5, 1999.

(51) Int. Cl.[7] ..... F16L 21/00; F16L 27/12

(52) U.S. Cl. ..... 285/226; 285/227; 285/298; 285/903; 405/133

(58) Field of Search ..... 285/226, 298, 285/299, 903, 227; 405/133, 134; 166/242.2

(56) References Cited

U.S. PATENT DOCUMENTS

| | | | | | |
|---|---|---|---|---|---|
| 1,880,218 | A | | 10/1932 | Simmons | |
| 2,582,249 | A | * | 1/1952 | Hendel | 285/226 |
| 3,431,975 | A | | 3/1969 | Blake | |
| 4,193,280 | A | | 3/1980 | Mazier | |
| 4,261,671 | A | | 4/1981 | Langner | |
| 5,026,206 | A | * | 6/1991 | Titmas et al. | 405/133 |
| 5,026,209 | A | * | 6/1991 | Titmas et al. | 405/133 |
| 5,275,240 | A | | 1/1994 | Peterson et al. | |
| 5,538,294 | A | * | 7/1996 | Thomas | 285/226 |

* cited by examiner

*Primary Examiner*—Neill Wilson
(74) *Attorney, Agent, or Firm*—Macheledt Bales LLP

(57) ABSTRACT

Thick-walled steel pipe is corrugated for the purpose of managing axial load when the pipe is used in an earth-restrained application. For example, the pipe may be used as casing in a cyclic steam stimulation well, where the axial loads are induced as the casing is heated and cooled.

17 Claims, 3 Drawing Sheets

"CORRUGATED THICK-WALLED PIPE FOR USE IN WELLBORES"

This application claims benefit of Prov. No. 60/132,632 filed May 5, 1999.

FIELD OF THE INVENTION

The present invention relates to corrugated pipe and its use in tubular strings conveying fluid through earth material, for example as part of a buried pipeline or casing in a well.

BACKGROUND OF THE INVENTION

The invention was initially developed as a means to reduce thermally induced axial load in the production casing string of a well undergoing cyclic steam stimulation. The production casing strings in such wells are normally cemented in place and are therefore largely constrained from expanding or contracting axially during heating and cooling cycles. This constrained thermal strain is manifested as axial load which becomes more compressive during heating and more tensile during cooling. Depending on the thermo-mechanical material properties of the casing and the magnitude of temperature cycling, the axial stress may exceed the axial yield strength of the pipe in compression during heating and may exceed the axial yield strength in tension during cooling. Among other consequences, the high stresses place severe demands on the structural and sealing capacity of the tubular connections between casing joints and significantly reduce the ability of the pipe body to withstand collapse, bending and shear loads which may arise from various hydraulic and geomechanical factors. The incidence of leakage, fracture and access impairment 'failures' is therefore relatively high in connection with the casing of thermal process wells.

Approaches taken by the industry to address this problem have typically included improving the strength and leakage resistance of the connections by utilizing more complex designs, for example substituting premium connections for the standard 8-round or buttress threadform connections, or increasing the grade of steel used. These approaches, while potentially providing significantly better seepage control and modest incremental structural performance, tend to increase cost and do not substantially reduce the risk of fracture or deformation induced failure.

Therefore there remains a need to address the primary confounding variable, namely the high axial stress induced by confined thermal expansion and contraction.

While thermal well design has been the primary motivator for the present invention, it is not to be limited to this application. The invention finds use in situations where there is interaction of loads between tubulars, surrounding earth material and contained or excluded pressure fluids, and where it would be desirable to increase axial or flexural compliance, decrease effective axial yield load and increase collapse resistance. One such situation involves buried pipelines. Here axial and flexural strain due to tubular-soil interaction must be absorbed without loss of pressure integrity. It would be desirable to provide tubulars of reduced axial and therefore flexural stiffness because these properties result in lower axial and bending loads than straight pipe for the same temperature variations and deformation magnitude.

SUMMARY OF THE INVENTION

The phrase "string of joints" as used herein is intended to encompass a plurality of joints of metal pipe, usually steel, connected end to end either by welding or threaded connections and to further encompass a sand exclusion liner if such a part of the string. The phrase "thick-walled pipe" is intended to mean substantially rigid high pressure pipe useful as oil country tubulars, such as well casing and in high pressure pipelines, said pipe having a diameter to wall thickness ratio ("D/t") less than 100, preferably less than 50. The word "formed" is intended to mean that a cylindrical metal pipe wall has been plastically deformed by hydroforming, rolling or hydrofolding, preferably triaxial plane strain hydroforming.

The present invention applies a well known mechanical design concept, corrugations, to thick-walled metal pipe which is to be used in earth-restrained applications, such as in a string of joints used as casing in a well or as part of a pipeline. The corrugations are incorporated for the purpose of managing changes in axial load subsequent to installation.

More specifically, the invention involves forming thick-walled pipe to convert at least part of its cylindrical side wall into a sinusoidally corrugated configuration. The corrugations are formed so as to have a corrugation radius of curvature to thickness ratio ("R/t") less than 10, preferably less than 5. Preferably the corrugation webs have a maximum angle equal to or greater than 20° with respect to the pipe axis. More preferably the corrugations have thinned webs and flattened peaks. Preferably, the pipe is hydroformed, without substantially changing its original length, to create the corrugations. By selecting the geometry defined by these limitations we have balanced axial compliance (i.e. reduced axial stiffness) with diametral limitations arising from the cost of increasing annular space consumed in a wellbore and material strain capacity.

Broadly stated then, in one embodiment the invention is concerned with a string of joints of thick-walled pipe extending through and being restrained by earth material, the string being subject to a change in axial load subsequent to installation, the side wall of at least one such joint having been formed into corrugations along at least part of its length, the corrugations having an R/t ratio less than 10. Preferably, one or more of the following conditions apply:

- the string is used in a well and is subject to changes in axial load arising from thermal expansion or contraction (for example where the well is involved in cyclic steam stimulation) or from earth movement;
- the string forms part of a buried pipeline;
- the R/t ratio is less than 5;
- a plurality of corrugated joints are distributed in spaced apart alignment along the string;
- the corrugation webs have a maximum angle equal to or greater than 20° relative to the pipe axis;
- the wall thickness of the webs of the corrugations are thinner than the peaks;
- the corrugations having been formed by hydroforming, more preferably while maintaining the length of the joint substantially constant;
- the corrugations varying in wall thickness along their length, as a result of having been formed.

In another embodiment, the invention is concerned with a thick-walled steel pipe having threaded ends, the body of the pipe between the ends having been hydroformed to produce corrugations along at least part of its length, the corrugations having an R/t ratio less than 10. Any of the previously mentioned preferred conditions also may be incorporated.

DESCRIPTION OF THE PREFERRED EMBODIMENT

Figure 1:
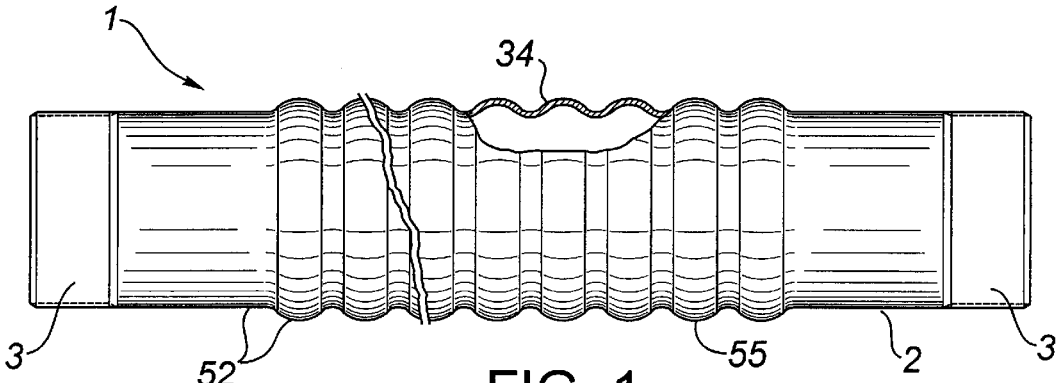
FIG. 1 is a partially cut-away side view of a corrugated casing joint having threaded ends.

While recognizing the likely benefits of corrugated earth restrained tubulars used for pipeline and well bore casing applications, the present invention also required a means to place corrugations in the metal tubular materials typically employed for these purposes. It was therefore desirable to devise a manufacturing or forming process capable of creating suitably shaped corrugations in the wall of standard casing and high pressure pipeline materials of more or less full standard joint length. Such tubulars have a D/t ratio less than 100, preferably less than 50. It was particularly desirable to discover a process suited to casing tubulars for use in well bores in a manner providing a geometry yielding suitable stress and strain behaviour under installation and operational loads within the allowable annular space.

Machining and forming are two techniques well known as means capable of producing corrugation geometries in metal tubulars. Machining provides a means to produce corrugation geometries of almost any desired shape, but it is difficult to implement on the internal surfaces of casing intervals beyond a few diameters of the tube ends. This technical difficulty, combined with the relatively high cost of machining compared to forming, makes forming or forming combined with only external machining the preferred alternative.

Existing methods for forming corrugated pipe or bellows from straight tube may generally be divided into rolling and hydroforming or hydrofolding processes. Rolling methods are used on thin-walled material having smaller diameter than that employed for casing or high pressure pipeline tubulars. While other variations of rolling are applicable to larger thicknesses, where for example an internal spiral grooved mandrel is placed on the inside of the pipe and external rollers are used to deform the pipe into the mandrel grooves, such localized forming methods do not enjoy the simplicity of the global forming accomplished with hydroforming.

It should be pointed out that forming corrugations in spiral welded pipe by placing corrugations in the strip prior to or during the welding process offers another realistic forming process for larger diameter high pressure pipeline tubulars. Of course this method cannot be applied to tubes and is not suitable for smaller diameter pipeline and casing sizes.

The manufacture of corrugated pipe or bellows for applications such as pipeline expansion joints, by hydroforming or hydrofolding, is a technique well known in the art. As described in U.S. Pat. No. 4,193,280, "In a process of this kind, the operation starts with a sheet-metal sleeve of a length greater than that of the bellows to be obtained, the said length being, in fact, equal to the developed length of the cylindrical ends of the said bellows and of the deformable corrugations therebetween. A series of suitably spaced rings is applied to the outer wall of the sleeve, which is preferably provided with end-flanges, and it is then placed upon the fixed platen of a press. The interior of the sleeve is filled with a liquid which escapes at a controlled rate and the press is operated in such a manner that the mobile platen is applied to one end of the assembly. The partially confined liquid inside the sleeve develops an internal pressure and, assisted by the axial load, causes the metal to deform outwardly between the forming rings, so that the bellows is eventually shaped."

As described, this technique does not contemplate application to casing and high pressure pipeline tubulars which have relatively smaller diameter to thickness (D/t) ratios than the pipe materials to which it is usually applied, described as a "sheet metal sleeve". Further, this description shows that the method as presently practiced does not contemplate changing the arc length of the shaped pipe, in that "the developed length" is expected to be the same as the initial "sheet metal sleeve" length. While the method does provide for direct control of corrugation period through selection of ring spacing and amount of axial compression, these parameters simultaneously control amplitude to a large extent. Little additional control of corrugation shape is possible beyond contouring of the confining rings and the natural unrestrained toroidal bulge formed between the rings. Control of wall thickness distribution is not considered as indicated for example by the use of the term "hydrofolding" and by the expectation that "the developed length" remains unchanged which can not in general be the case if thickness is to be varied. However for application to casing and high pressure pipeline tubular corrugation, it is desirable to obtain corrugations without dramatic changes in original tubular length, to more independently control period and amplitude and to control aspects of the local corrugation geometry variables such as shape and thickness.

Before considering how the modified hydroforming process of the present invention may be used to overcome these difficulties and limitations and provide other advantages, it is desirable to consider the relationship between these corrugation geometry variables and corrugated casing performance. It is thus also desirable to consider how the corrugations to be introduced into casing materials differ from the accepted understanding of corrugation geometry.

As a term well accepted in the art, a pipe corrugation is generally meant to describe a wrinkle or wave in the wall of otherwise cylindrical tubes. Such corrugations commonly go from peak to valley to peak to valley etc. along all or some portion of the pipe length and, even when helical, are largely circumferential in orientation. This understanding also carries the assumption that the material thickness does not vary substantially along the wave and that these pipes may be treated as shells for stress analysis purposes. Such corrugations or bellows may be treated as shells, and design characteristics such as stress and displacement response to load obtained using standard treatments, such as given, for example, by W. C. Young, "Roark's Formulas for Stress and Strain", Sixth Edition, McGraw Hill Inc., 1989, pg 570. However such treatments break down where the ratio of corrugation radius of curvature to thickness becomes small. In the given reference, this occurs for R/t ratios less than 10.

While the term corrugation is applied herein to convey the general sense of the modified casing wall geometry intended to provide the benefits of the present invention, the peculiar requirements of the well bore casing application require corrugation geometries substantially outside the understandings of corrugations usual to the art. To provide corrugations with a significant reduction in axial compliance and yield load as needed for the intended applications, it is generally desirable to create corrugations with a maximum web angle greater than about 20° with respect to the pipe axis. To stay within reasonable amplitudes, and to further optimize the stress and strain distributions by varying the wall thickness over the corrugation interval or wavelength, this implies a radius of curvature to thickness ratio substantially less than 10, preferably less than 5, is needed. It is therefore necessary to consider the corrugations to be placed in casing or pipeline tubular walls as thickwall corrugations and to obtain estimates of performance determining stress and strain variables accordingly.

As will be evident to one skilled in the art, the corrugation amplitude is constrained to occur within the annular clearances allowable by both outer and inner confining surfaces, typically the well bore wall and production tubing respectively, plus additional running and cementing clearances. Within this constraint, the corrugation geometry produced to obtain the desired reduction in axial stiffness must still provide for sufficient strength to run the tubular, and perhaps react pressure end load. While meeting these basic requirements it is further desirable to obtain a geometry which will produce an axial load significantly lower than occurs with cylindrical pipe when heated, but not at the expense of high cyclic plastic strain, a parameter that strongly controls the corrosion fatigue failure response. To obtain significant stiffness reduction, the angle of the pipe wall portion falling between the peaks and valleys of the corrugation, referred to here as the corrugation web, should be increased substantially, typically above 45° with respect to the axis. This necessitates relatively sharp curvatures in the peak and valley regions to prevent amplitudes exceeding the available annular space. For casing and high pressure pipeline tubulars these curvatures result in R/t ratios nearer 1 than 10, placing such corrugations well beyond the limits of standard membrane stress analysis treatments. Particularly at the peak locations, this tends to result in severe flexural stress or strain concentrations under axial loading if typical toroidal geometries are employed. It is therefore beneficial to provide a geometry where the peaks are somewhat flattened to distribute the flexural strain over a longer interval. It is further beneficial to provide a geometry where the web portions of the wall are somewhat thinner, providing a further improvement of stress distribution and lower axial stiffness within the same annular space constraint. Because the flexural wall stiffness is a very strong function of thickness (proportional to the third power of thickness for elastic deformations) apparently small variations in thickness appear to have a disproportionately large effect on stress distribution.

Control of such geometry considerations, arising as they do from the thick wall nature of casing corrugations, are not generally contemplated in existing hydroforming processes. As already discussed, the corrugations to be formed by these existing processes are largely constant thickness, toroidal at peaks and valleys and thin wall in nature. The term 'triaxial hydroforming' has therefore been adopted herein to describe the more specialized process needed to produce casing containing thick wall corrugations better suited to earth-restrained tubular design requirements. This process typically requires higher pressures, greater control of the axial load and is more sensitive to friction behaviour between the tubular and confining mold than hydrofolding where compressive load is primarily used to cause internally pressured pipe to buckle between confining rings.

It has been found that triaxial hydroforming conducted under global plane strain conditions, where the corrugations are formed by application of high internal fluid pressure while the overall pipe length is kept constant, produces a corrugation geometry well suited to thermal strain absorption. In this case the axial force is in fact tensile during forming, and the resulting plastic material flow which is further controlled by contact and friction induced stress between the pipe and form, produce an advantageous thinning in the web region of the corrugation during forming of the corrugation 'bulge' under pressure.

But this is just one combination of axial load or displacement and pressure or fluid volume control. Other combinations are possible as for example would occur if no axial load were applied (plane stress) and forming was completely accomplished by the application of internal pressure causing bulges to form between rings as commonly used for hydroforming. Such variants of the pressure axial load relationship may be manipulated to produce geometries having characteristics suitable for particular applications and to simultaneously control the change in overall tubular length caused by the forming process.

The simplicity of the triaxial plane strain forming process used to produce this corrugation geometry of the preferred embodiment, lends itself particularly well to modest manufacturing cost and small annular space requirements. The resulting tubular architecture is well suited for use in wells using the cyclic steam stimulation production method, as well as other applications benefiting from tubulars with reduced axial load or greater strain absorption to prevent the instabilities associated with global plastic deformation. The plane strain condition enjoys the further advantage of maintaining the original joint length which facilitates interchangeability between corrugated and straight tubulars.

From the foregoing, it should be apparent to one skilled in the art, that the fundamental triaxial process variables of confining mold shape, axial load or strain, internal pressure and contact friction, enables a pipe corrugation to be configured with significant control over both the corrugation amplitude as a function of axial length and its thickness distribution to help control stress and strain response to meet a large spectrum of design requirements for earth restrained tubular systems. However corrugation shape obtained by plane strain hydroforming provides a particularly well conditioned corrugation shape for application to cyclic steam stimulation well completion applications as anticipated in the preferred embodiment.

The placement of suitable corrugations in the tubular wall is supported through provision of a specialized hydroforming process providing a means of creating axially compliant corrugation geometries without substantial internal machining which process employs control of axial length during hydroforming and is therefore capable of controlling the change in the length of the tubular being formed. The hydroforming process comprises the steps of:

placing a length of cylindrical tube inside a confining surface comprised of elements spaced and shaped to control the joint geometry to generally have corrugations in the mid-section and cylindrical end sections and contained within a confining tube supporting or guiding the elements creating the confining surface;

applying sufficient internal pressure to force the tubular wall radially outward against the confining surface while simultaneously controlling the axial length of the tubular during and after application of internal pressure and thus plastically form the tubular article where such axial length control is preferably such that the original tubular length is substantially preserved or unchanged;

removing the formed corrugated tubular joint from the forming apparatus which removal may be facilitated by the application of external pressure sufficient to free the article from the confining surface; and additionally finishing the formed joint, if required, by external machining of the corrugations to further control the final geometry or machining of the cylindrical ends to provide for joining by threaded connections, welding or other joining method.

In its preferred embodiment, corrugated joints 1 are provided, forming part of a string 50 of non-corrugated pipe joints. The joint has a side wall 52 comprising a corrugated mid-section 55 and cylindrical non-corrugated end sections 2. The end sections 2 facilitate joining, using industry standard methods such as welding for pipelines or threaded connections for well bore casing. Such a joint of corrugated casing is shown in FIG. 1 with threaded pin ends 3. The diameter and wall thickness of the cylindrical end sections 2 are chosen to ensure compatibility with industry sizing standards. The cylindrical end length would typically be chosen to allow for gripping with standard connection make up and handling equipment. In certain cases other operational or completion requirements such as packer setting locations may dictate longer cylindrical intervals at the ends or additional cylindrical sections elsewhere along the joint length. Also, as shown in FIG. 1, the corrugation valleys are arranged to coincide with the nominal pipe internal diameter so that the corrugation amplitude has the effect of increasing the effective pipe body diameter. While it is expected this configuration will be desirable for most applications, a corrugation valley diameter less than the nominal pipe diameter may also be provided.

Figure 2:
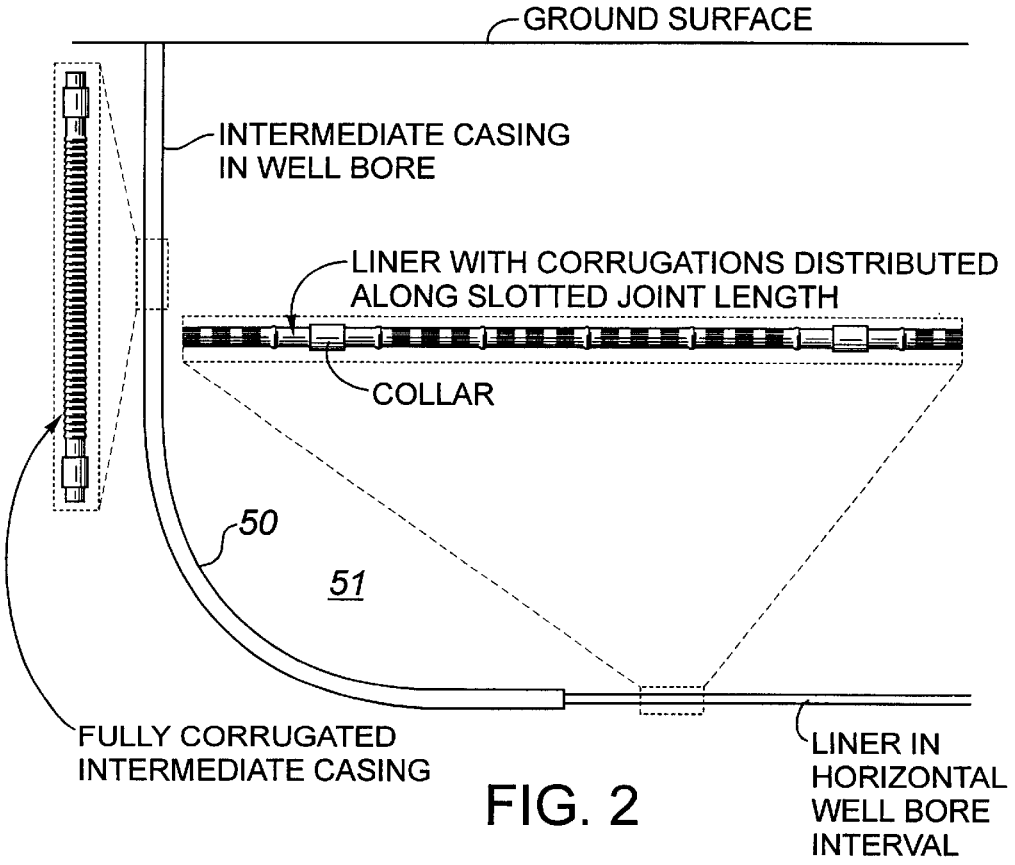
FIG. 2 is a schematic side view showing a corrugated casing joint incorporated into a casing string having a slotted liner, such as would be used in a thermal horizontal well.

The triaxial plane strain hydroforming process preferred to provide such an article of corrugated casing requires an apparatus 4 such as shown in FIG. 2. In this apparatus 4, a confining tube 5 is provided with sealing annular end closures 6 and a contoured form 7. The form 7 comprises elements providing cylindrical end sections 8 and a centre corrugating section 9 closely fitting inside said confining tube 5. The tube 5, end closures 6 and contoured form 7 together comprise a forming vessel 30. A forming fluid access port 10 is provided in one annular end closure 6. A mandrel 11 with external end seals 12 and a forming fluid access port 13 is also provided.

Figure 3:
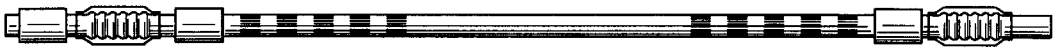
FIG. 3 is a side view showing an arrangement of corrugated joints incorporated into a slotted liner.

The centre corrugating section 9 is constructed of various axisymmetric ring and sleeve elements 14, 15 as shown in FIGS. 2 and 3. To facilitate removal after forming, some or all of these elements 14, 15 are split. Element shapes comprising the forming profile are selected to provide a distribution of void space into which the tubular material is caused to flow under the application of internal pressure. Friction forces activated by contact stress between the confining surface and casing joint 16 also contribute to controlling plastic flow during forming. For a given tubular, the final corrugation shape is thus controlled by void space distribution, lubrication or friction coefficient in the interfacial region between the casing joint 16 and form 7 and forming pressure.

The cylindrical end sections 8 have an internal diameter only slightly larger than the outside diameter of the casing joint 16 to be formed to provide casing joint end sections 2 of standard dimensions suitable for threading and handling. The end sections 8 need not be split to allow removal. If desired, the ring and sleeve elements 14, 15 of the centre corrugating section 9, and indeed the cylindrical end sections 8 as well, may all be provided as a single split half form. This configuration of the form or mold permits more rapid assembly and disassembly where repeated forming is required.

Figure 4:
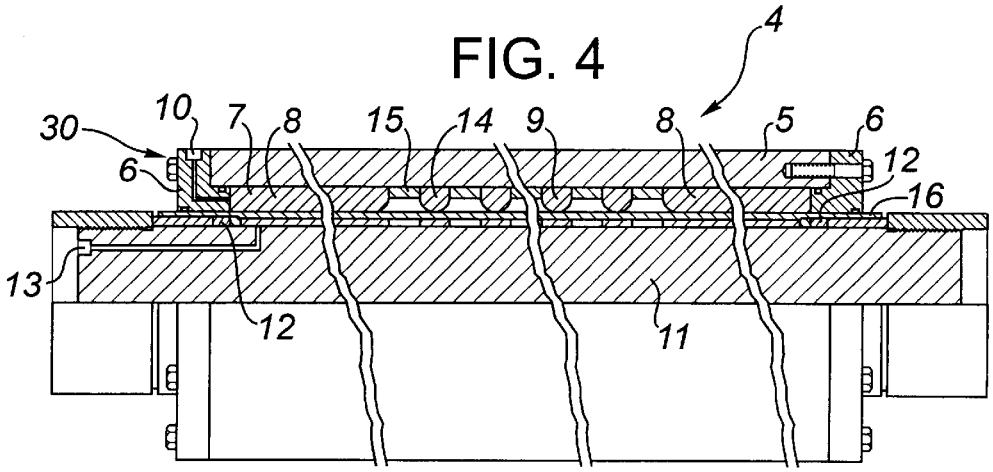
FIG. 4 is a partially sectional side view of a joint of straight-walled pipe installed in tri-axial plane strain hydroforming apparatus, prior to application of forming pressure.

As shown in FIG. 4, the casing joint 16 is placed inside the forming vessel 30 and the mandrel 11 is placed inside the casing joint. The mandrel 11 is provided with seals 32 for sealing against the inside surface 31 of the casing joint 16 at two locations, typically near the joint ends. The seals 32 are spaced to provide an interval of the casing joint, inside the forming vessel 30, that may be internally fluid loaded to a pressure causing the casing material to plastically expand outward. Similarly the annular end closures are provided with seals 33 to seal between the casing joint exterior and confining tube end closures 6 at nearly the same axial position as the mandrel seals 32, so that the casing joint may be externally pressured over the same interval.

Thus arranged, the apparatus 4 is used to form the casing joint 16 by first applying internal pressure, beyond the pipe body yield, to expand the casing material outward against the inside surface 38 of the corrugating section 9. The inner contoured form of the forming vessel 30 is provided to control the shape of the external expansion of the casing material so that as internal pressure is increased the casing material will be progressively forced into contact with the profiled surface 38 as shown in FIG. 3.

Figure 5:
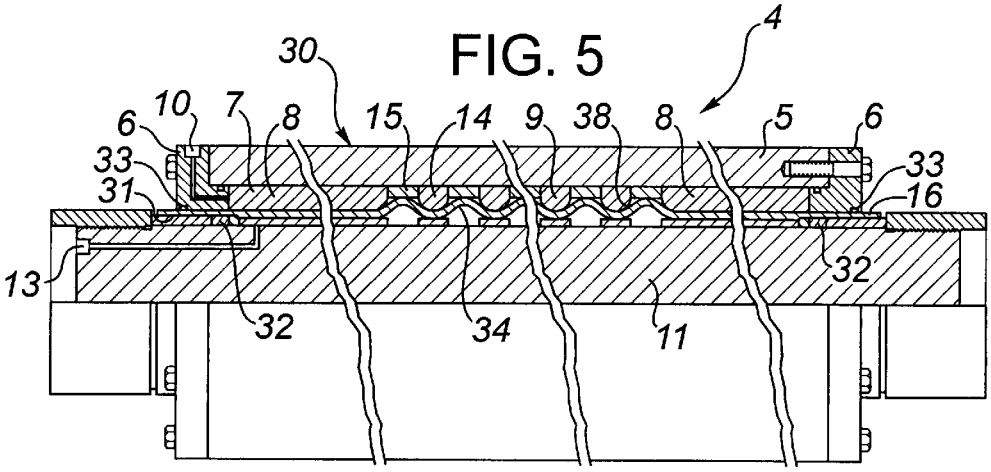
FIG. 5 is similar to FIG. 2 after the joint has been formed to provide corrugations.

As shown in FIG. 5, the casing joint length is not substantially reduced by this process as in typical hydroforming or hydrofolding processes used to provide corrugated pipe. It will be clear that the plane strain forming condition requires the development of axial tensile stress as the corrugations 34 are formed. The apparatus 4 reacts the resulting force through friction forces developed along the cylindrical end sleeves. The friction forces are enabled by contact stress between the internally pressured casing material and the confining form end sections 8 as pressure is initially increased beyond that required to initiate yield and close the relatively small installation gap provided between the casing joint and form end sections 8. Further increases of pressure are used to cause flow into the corrugation voids to the extent required to form corrugation geometries providing substantial reductions in tubular axial compliance, where the pressure required to cause such deformation magnitudes will typically exceed the casing material yield pressure by several times.

Following forming under these high pressures, the residual contact stress between the casing joint 16 and contoured form surface 38 tends to preclude straightforward removal of the casing joint 16 from the forming vessel 30. Therefore the forming process is completed by applying sufficient external pressure through port 10 to plastically yield the casing joint and cause inward radial deformation to form a gap between the joint and contoured form surface 38 and thus substantially eliminate the residual contact stress inhibiting removal. The pressure and sealing capacity of the annular end closures 6 and seals 33 need only provide sufficient containment to cause global pipe body yield.

Following application and removal of external pressure, the mandrel and at least one end cap are removed. The casing and contoured form are then removed and finally the elements of the form removed from the casing. The process may be repeated to form additional joints of formed pipe.

In certain applications, the utility of the corrugated pipe formed by this process may be further enhanced by heat treatment, such as annealing for steel, after forming. This may be needed because the amount of plastic deformation imposed by the forming process may affect performance properties such as corrosion sensitivity, fatigue life or simply remaining plastic capacity.

Figure 6:
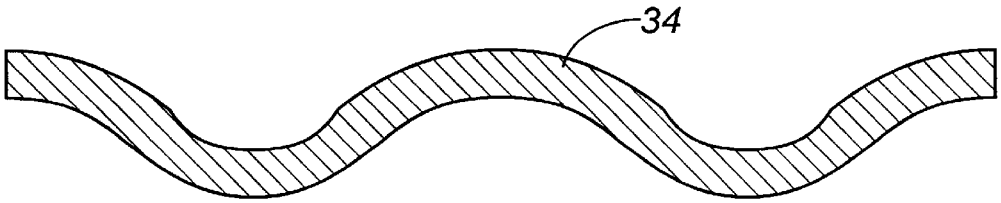
FIG. 6 is a longitudinal sectional side view of the corrugated joint as formed under plane strain conditions, showing thickness variations.
Figure 7:
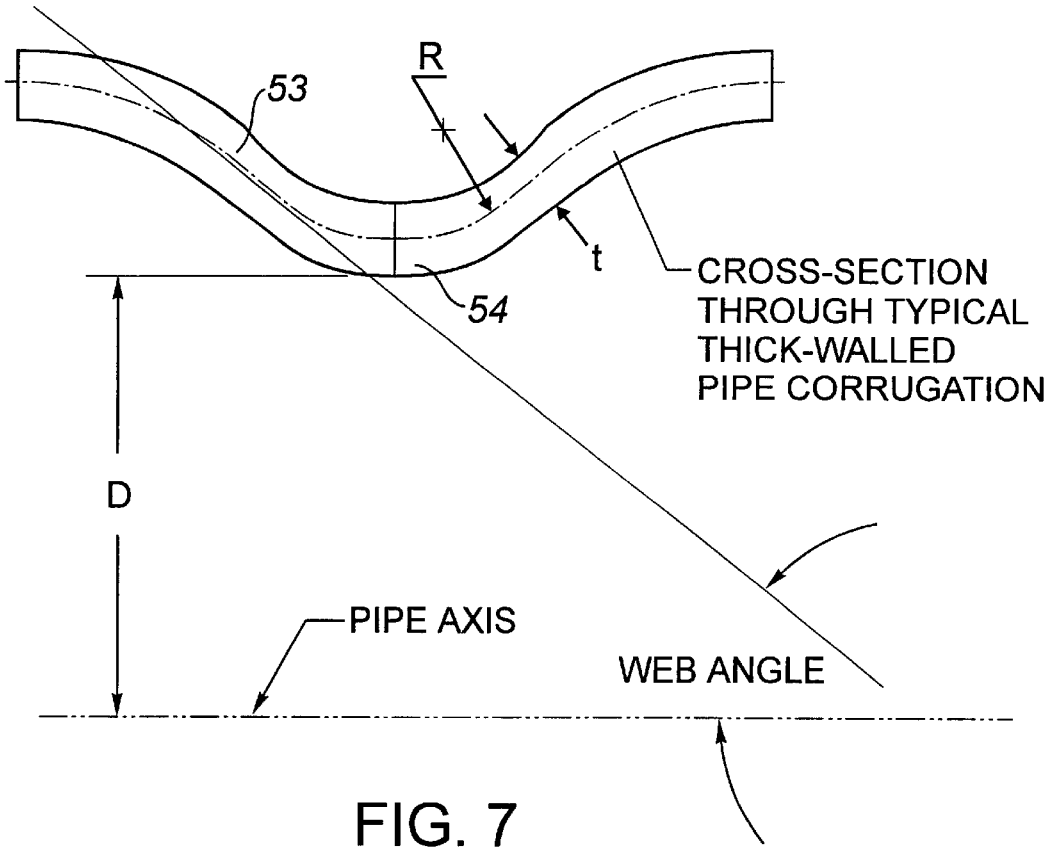
FIG. 7 is a side view of part of FIG. 6, showing corrugation and pipe geometry parameters.

A typical thick wall corrugation geometry of the casing joint shown in FIG. 1, and formed by the plane strain tri-axial hydroforming process, is shown in FIG. 6. This figure shows a cross section through several corrugations 34. Each corrugation 34 comprises webs 53 and a peak 54. Preferably the webs 54 are disposed at a web angle of about 20°. The relatively subtle variations in thickness obtained using the triaxial forming process are evident. Stress analysis of this geometry using the finite element method was used to calculate a reduction in axial stiffness of approximately 5 times that of the original non-corrugated straight pipe.

EXAMPLE

To illustrate the utility of the present invention in reducing thermally induced axial load, consider a well where cylindrical steel casing with yield strength of 550 MPa is cemented at 20° C. with negligible axial load and is subsequently heated to 250° C. Typical properties for the thermal expansion coefficient and elastic modulus of casing steel are 12 microstrain/C and 200 GPa respectively. For such a material, provided its elastic limit is not exceeded, the axial stress increase upon heating is calculated from the relation, Axial stress=temperature change×expansion coefficient×elastic modulus=552 Mpa.

The casing will thus be just at its yield load with consequent deleterious impact on connection and pipe body resistance to failure. However in this same application, casing with corrugations such as shown in FIG. 6 over most of its length would reduce this load by a factor of nearly 5, reducing the axial stress to 110 MPa, placing the casing and connections in a much more favorable load operating regime.

As an alternative to hydroforming by application of internal pressure to expand a tubular against an external form as described in the preferred embodiment, this process may be inverted to apply external pressure to the tubular and providing a form internal to the tubular. In this case the form would typically be configured to provide spiral corrugations to facilitate removal.

In another aspect, we believe the properties of corrugations provided by the tri-axial hydroforming process may be further improved for certain applications through selectively removing material by external machining either before or after hydroforming. For example such machining can be used to further thin the web thickness and extend the range of available elastic deformation.

In another aspect, a cylindrical liner with a first and second end is provided on the interior of a corrugated tubular joint with first and second ends where the first end of the liner is joined/fastened to the first end of the corrugated tubular joint and said liner extends to cover all or a portion of the corrugated interval. This configuration permits telescopic sliding of the straight liner relative to the corrugated tubular to provide a system retaining the axial compliance of the corrugated tubular but having increased flexural stiffness and therefore buckling stability, reduced flow losses, simpler cleaning with pigs or wiper plugs and a smooth surface for sealing of devices such as packers. In a further aspect of such a corrugated tubular with internal liner the second end of the liner and second end of the tubular may be provided with interlocking stop rings or similar devices permitting the telescopic relative axial movement only over a certain range where this range can be arranged to limit the stretch or compression of the corrugated tubular to prevent excess strain.

In another aspect, a cylindrical liner with a first and second end is provided on the exterior of a corrugated tubular joint with first and second ends where the first end of the liner is joined/fastened to the first end of the corrugated tubular joint and said liner extends to cover all or a portion of the corrugated interval. This configuration permits telescopic sliding of the straight liner relative to the corrugated tubular to provide a system retaining the axial compliance of the corrugated tubular but having increased flexural stiffness and therefore buckling stability. In a further aspect of such a corrugated tubular with external liner the second end of the liner and second end of the tubular may be provided with interlocking stop rings or similar devices permitting the telescopic relative axial movement only over a certain range where this range can be arranged to limit the stretch or compression of the corrugated tubular to prevent excess strain.

In another aspect, the end sections of the forms may be configured to form expanded tubular intervals suitable for internal threading and thus simultaneously form a tubular article with corrugations and an integral box connection on one or both ends.

In another aspect, the forming vessel may be arranged as a split form.

In another aspect, the forming elements may be arranged to provide helical corrugations.

As an alternative embodiment, we believe an axially compliant tubular may be formed by providing forming elements arranged to create a double helix corrugation using left and right helixes. Such a geometry is similar to that occurring in diamond wall buckling of thin cylinders.

As an alternative embodiment, we believe the corrugation geometry may be further controlled by application of axial load subsequent to hydroforming where such load would typically be compressive.

As a further alternative embodiment to control corrugation geometry, we believe the forming process may be conducted with independent control of axial displacement as a function of forming fluid pressure or volume control. This embodiment requires the form to be arranged with the corrugating section having floating restraint rings confining the profiled split rings and at one of the end cylindrical sections arranged to telescope within the confining tube and on the mandrel. Control of the axial displacement of this telescoping end section with respect to the confining tube by means of a hydraulic ram or other suitable load application device then permits the desired independence of axial and pressure loads or displacements.

In another aspect, material may be placed in the space between some or all of the corrugations, either on the outside or inside, as a means to control or limit the compressive load displacement response of individual corrugations. Materials suitable for this purpose include plastic, cement, split sleeves, rings or springs which may be used separately or in combination with each other.

In another aspect, the corrugation amplitude at the ends of a corrugated interval may be ramped down over the last few corrugations to provide a more gradual axial stiffness contrast between cylindrical and corrugated tubular wall intervals.

The embodiments of the invention in which an exclusive property or privilege is claimed are defined as follows:

1. A string of joints of metal thick-walled pipe extending through and being restrained by earth material, the string being subject to change in axial load subsequent to installation, the string comprising:

at least one such joint having a side wall which has been formed along at least part of its length into sinusoidal corrugations;

the corrugated joint having a diameter to wall thickness ratio (D/t) less than 100;

the corrugations having a corrugation radius of curvature to thickness ratio (R/t) less than 10; and the corrugations varying in wall thickness along their length, as a result of having been formed.

2. The string as set forth in claim 1, wherein:

the corrugated joint side wall has been hydroformed to create the corrugations.

3. The string as set forth in claim 1 wherein:

the corrugated joint side wall has been hydroformed while maintaining the length of the joint substantially constant.

4. The string as set forth in claim 1 wherein:

the corrugations have a D/t less than 50 and an R/t less than 5.

5. The string as set forth in claim 2 wherein:

the corrugations have a D/t less than 50 and an R/t less than 5.

6. The string as set forth in claim 3 wherein:

the corrugations have a D/t less than 50 and an R/t less than 5.

7. The string as set forth in claim 1 wherein:

the corrugations have webs and peaks and the webs have a web angle of at least 20° with respect to the axis of the corrugated joint.

8. The string as set forth in claim 3 wherein:

the corrugations have webs and peaks and the webs have a web angle of at least 20° with respect to the axis of the corrugated joint.

9. The string as set forth in claim 4 wherein:

the corrugations have webs and peaks and the webs have a web angle of at least 20° with respect to the axis of the corrugated joint.

10. The string as set forth in claim 5 wherein:

the corrugations have webs and peaks and the webs have a web angle of at least 20° with respect to the axis of the corrugated joint.

11. The string as set forth in claim 6 wherein:

the corrugations have webs and peaks and the webs have a web angle of at least 20° with respect to the axis of the corrugated joint.

12. A joint of steel pipe having a longitudinal axis, comprising:

a tubular body having a side wall, the body side wall having been formed along at least part of its length into sinusoidal corrugations;

the side wall having a diameter to wall thickness ratio (D/t) less than 100;

the corrugations having a corrugation radius of curvature to thickness ratio (R/t) less than 10; and the corrugations varying in wall thickness along their length, as a result of having been formed.

13. The joint as set forth in claim 12 wherein:

the corrugated side wall has been hydroformed, while maintaining the length of the joint substantially constant, to create the corrugations.

14. The joint as set forth in claim 12 wherein:

the corrugations have a D/t less than 50 and an R/t less than 5.

15. The joint as set forth in claim 13 wherein:

the corrugations have a D/t less than 50 and an R/t less than 5.

16. The joint as set forth in claim 13 wherein the corrugations have webs and peaks and the webs have a web angle of at least 20° with respect to the axis of the joint.

17. The joint as set forth in claim 15 wherein the corrugations have webs and peaks and the webs have a web angle of at least 20° with respect to the axis of the joint.

* * * * *